US007318555B1

(12) United States Patent
Ueda et al.

(10) Patent No.: US 7,318,555 B1
(45) Date of Patent: Jan. 15, 2008

(54) BOTTLE WASHING NOZZLE

(75) Inventors: Nobuyuki Ueda, Yokohama (JP); Nobuaki Nagatani, Yokohama (JP); Akira Abe, Tokyo (JP); Hideo Shibata, Tokyo (JP)

(73) Assignee: Toyo Seikan Kaisha, Ltd., Tokyo (JP)

( * ) Notice: Subject to any disclaimer, the term of this patent is extended or adjusted under 35 U.S.C. 154(b) by 0 days.

(21) Appl. No.: 11/484,736

(22) Filed: Jul. 12, 2006

(51) Int. Cl.

| | |
|---|---|
| ***B08B 9/20*** | (2006.01) |
| ***B08B 9/093*** | (2006.01) |
| ***B08B 9/28*** | (2006.01) |
| ***B08B 9/08*** | (2006.01) |
| ***B08B 3/02*** | (2006.01) |
| ***B05B 1/14*** | (2006.01) |
| ***B05B 1/30*** | (2006.01) |

(52) U.S. Cl. ..... 239/561; 239/543; 239/548; 239/556; 239/DIG. 13; 134/168 R; 134/198

(58) Field of Classification Search ..... 239/561, 239/543, 548, 556, DIG. 13, 544, 558, 559, 239/560, 567, 589, 598; 134/168 R, 198, 134/166 R, 167 R See application file for complete search history.

(56) References Cited

U.S. PATENT DOCUMENTS 1,940,615 A * 12/1933 Webster ..... 134/167 R
2,813,753 A * 11/1957 Roberts ..... 239/271
5,419,348 A * 5/1995 Kuta ..... 134/58 R
5,706,842 A * 1/1998 Caimi et al. ..... 134/113
5,996,600 A * 12/1999 Ostry ..... 134/169 R

FOREIGN PATENT DOCUMENTS

| | | |
|---|---|---|
| JP | 63-82989 A | 4/1988 |
| JP | 3-75853 U | 7/1991 |
| JP | 2003-181404 A | 7/2003 |

* cited by examiner

*Primary Examiner*—Darren Gorman
(74) *Attorney, Agent, or Firm*—Westerman, Hattori, Daniels & Adrian, LLP.

(57) ABSTRACT

A bottle washing nozzle which is capable of washing bottles having openings of different diameters and which is capable of washing bottles having projections, indentations, and a square cross-section, or the like, with good efficiency. The nozzle includes a central jet tube a first jet orifice which jets in a vertical direction, second jet orifices which jet in an oblique upward direction in the base section of the central jet tube, and an discharge controlling means in the outer circumferential section of the nozzle main body, below the second jet orifices.

4 Claims, 4 Drawing Sheets

Fig. 1-A
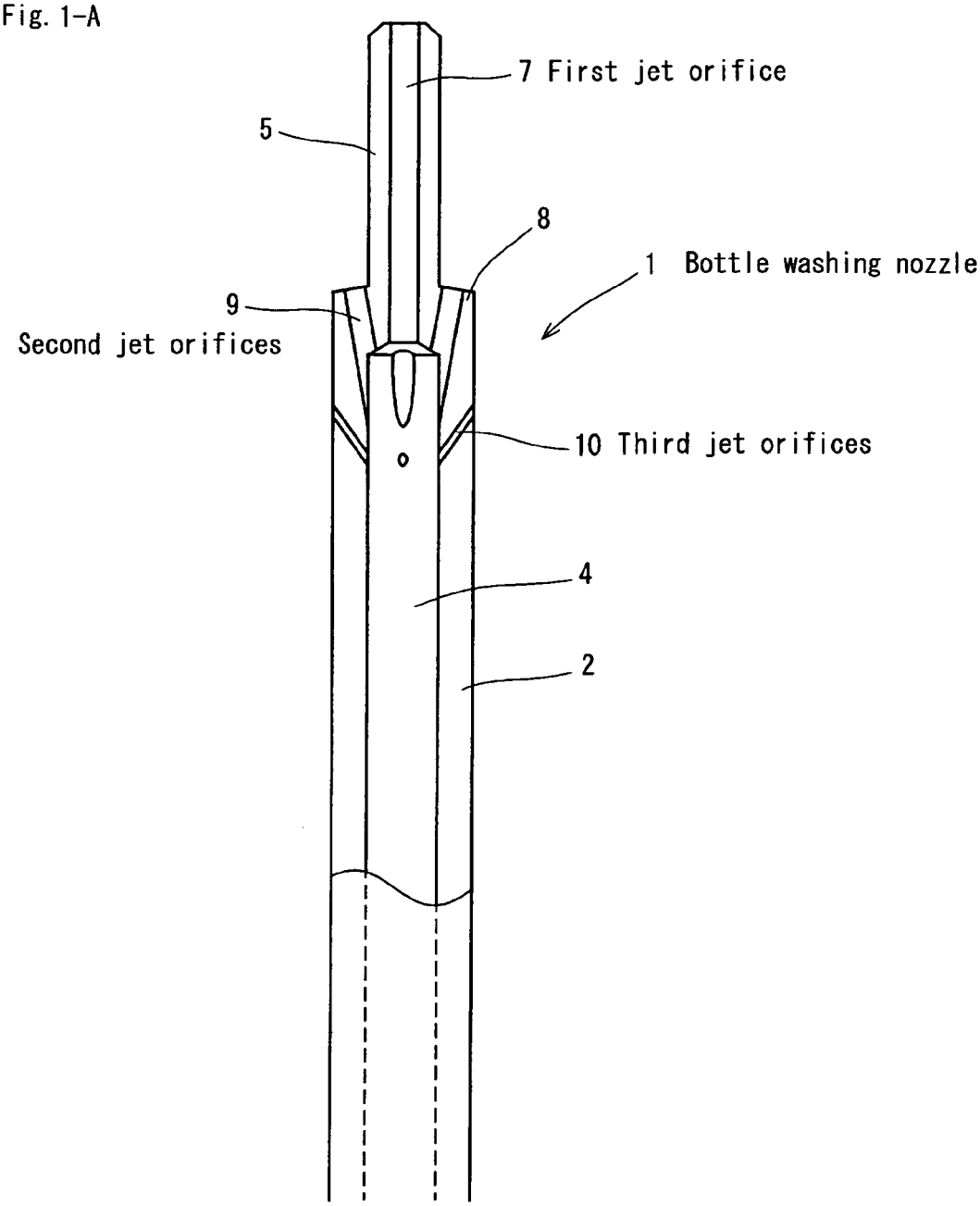
Fig. 1-B
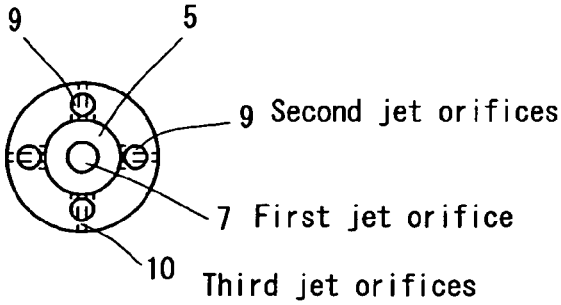

Fig. 3-A
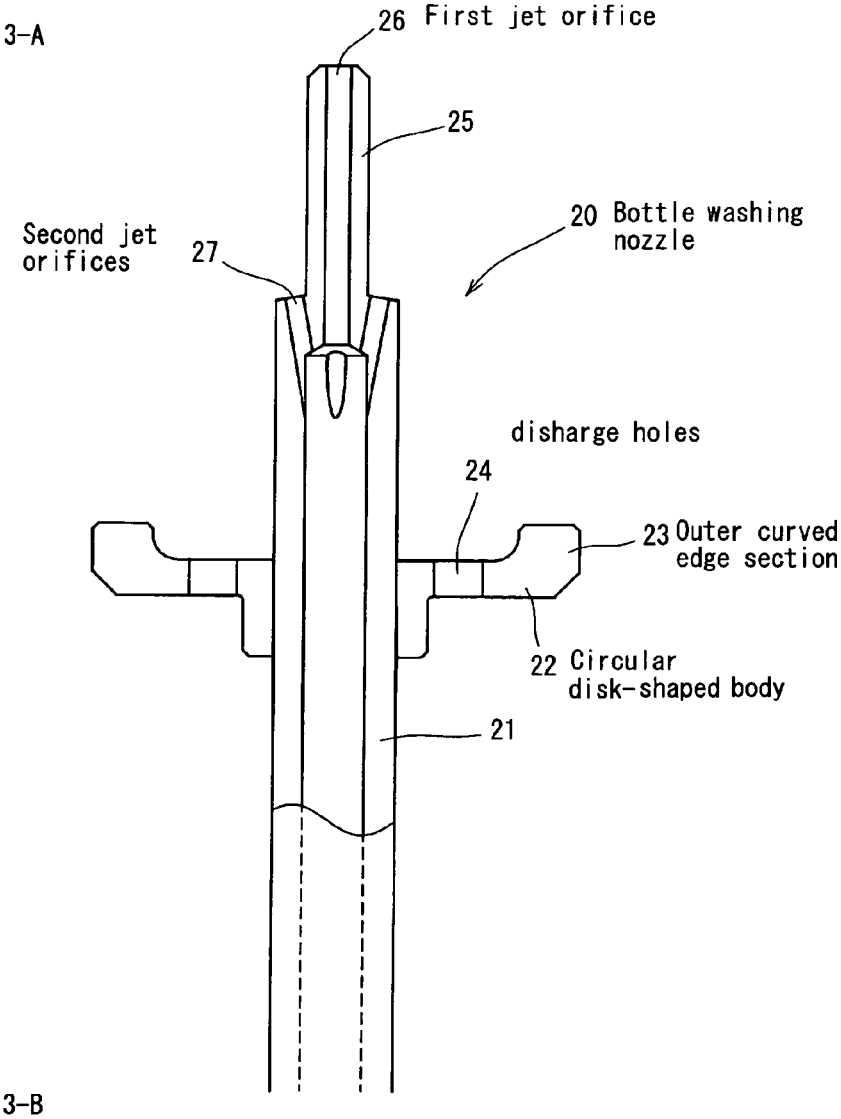
Fig. 3-B
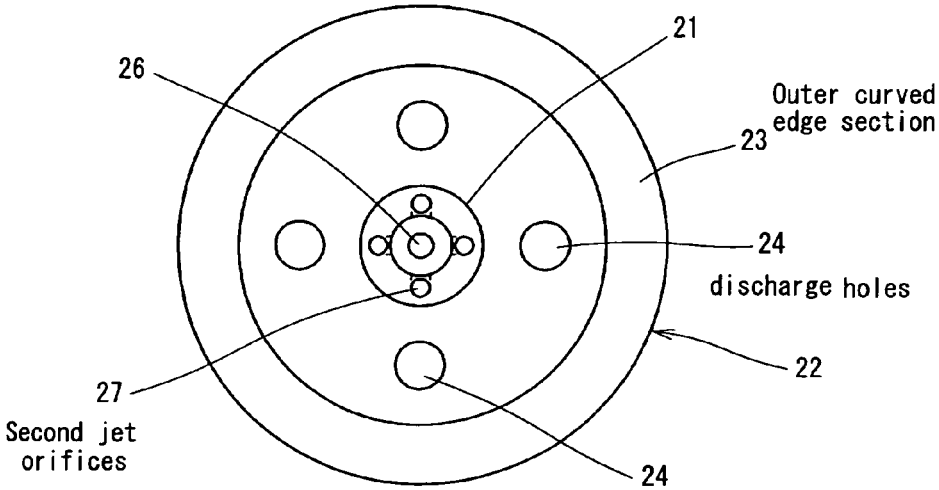

BOTTLE WASHING NOZZLE

BACKGROUND OF THE INVENTION

1. Field of the Invention

The present invention relates to a bottle washing nozzle in order to wash the interior of a bottle with a washing liquid, prior to filling contents into the bottle, in a contents filling line, or the like.

2. Description of the Related Art

In recent years, various sterilization and filling methods have been used as bottle filling methods, which prevent deterioration of the flavor of the contents due to heating, while maintaining a state of high quality. During sterilization and filling, the interior of the bottle is sterilized with a sterilization liquid, whereupon aseptic water is jetted inside the bottle, thereby flushing out and removing the sterilization liquid, but in the case of synthetic resin bottles such as a PET (polyethylene terephthalate) bottle, there are ribs, indentations and projections in a body wall, and although it is possible to wash completely points which are difficult to clean, such as ribs, indentations and projections, or corner sections, simply by means of introducing a washing nozzle through a bottle opening and jetting a washing liquid inside the bottle, provided that the liquid is jetted for a long period of time, it is difficult to sterilize the bottle by means of sterilization liquid and to completely flush out the sterilization liquid, subsequently, in a short period of time in a high-speed line. In particular, this is even more difficult in cases when the bottle has a non-circular, quadrilateral cross-section.

Conventionally, as a device for uniformly washing the inner surfaces of the bottle, it is common to combine use of jetting the washing liquid from the center of the nozzle, and jetting from the periphery thereof (see, for example, the Japanese Patent Publication No. S63-82989, and the Utility Model Publication No. H3-75853). However, in this case, since the bottle is cleaned by means of washing liquid jetted directly onto the inner surfaces of the bottle from both nozzles, there is a drawback in that a large quantity of washing liquid is required and washing efficiency is poor. In order to resolve this problem, as a method for washing the interior of a bottle more efficiently, the present inventors have devised a two-stage nozzle having a first jet orifice which opens at the front end section, and a second jet orifice which opens at a position below the front end section, and they have proposed a method for washing using this two-stage nozzle (see, for example, the Japanese Patent Publication No. 2003-181404).

The washing method according to the Japanese Patent Publication No. 2003-181404 is performed efficiently by reducing the time required for sterilization and washing of the inner surfaces of the container, without having to produce a relative swaying motion between the container and the bottle washing nozzle, and it aims to simplify the equipment required for sterilization and washing. However, the proposed washing nozzle is suitable for washing bottles having opening diameters within a certain specific range, but it does not allow efficient washing by means of the same washing nozzle when washing bottles having widely varying opening diameters due to model switching. Therefore, washing nozzles of different sizes must be used in accordance with the diameter of the opening in the bottle. For example, there is a problem in that if a bottle having a 38 dia. opening is washed with a washing nozzle designed for a bottle having a 28 dia. opening, then the dispersive effect of the washing liquid inside the container is lost, and all of the internal surfaces of a bottle having ribs or other indentations and projections, or a bottle of square cross-section having corner sections, or the like, are not wetted by the washing liquid, and hence washing non-uniformities arise.

SUMMARY OF THE INVENTION

The object of the present invention is to provide a bottle washing nozzle whereby washing liquid makes contact completely with all of the inner surfaces of a bottle, even in the case of bottles of different opening diameters, and whereby washing can be performed efficiently by causing the washing liquid to make full contact with the inner surfaces of the bottle, even in the case of a bottle having indentations and projections, such as ribs, or a bottle having a quadrilateral cross-section, such as corner sections.

The present invention seeks to further improve the technology proposed in Japanese Patent Publication No. 2003-181404, thereby resolving the aforementioned problems, by effectively raising the dispersion effect of the washing liquid in order to increase the washing effect inside the bottle, and in order to raise this dispersion effect, it is able to make the washing liquid inside the bottle collect up to or above the position of second jet orifices, during washing, even in the case of bottles of different opening diameters, in such a manner that this collected washing liquid is blown upward by the washing liquid jetted from the second jet orifices and is thus dispersed throughout the whole of the interior of the container. The amount of washing liquid collected inside the bottle is also affected by the flow rate of the liquid jetted into the bottle, but the major factor is the area of the opening formed between the outer diameter of a nozzle and the inner diameter of a bottle opening. By making this opening have a relatively small area in such a manner that the amount of liquid flowing out of the bottle is smaller than the amount of jetted liquid, then it is possible to restrict the outflow of liquid, but in this case, the outer diameter of the nozzle must be changed in accordance with variation in the diameter of the opening of the bottle, and hence it is not possible to handle bottles of different diameter openings by means of the same nozzle. In the present invention, in order to be able to handle bottles having openings of different diameters, a discharge controlling means is provided below the second jet orifices, in the bottle washing nozzle described in the Japanese Patent Publication No. 2003-181404.

In other words, in order to resolve the aforementioned problem, the bottle washing nozzle according to the present invention is a bottle washing nozzle which jets a washing liquid inside a bottle, comprising: a first jet orifice which jets in a vertical direction and is formed in a central jet tube, provided in the upper end portion of a nozzle main body comprising a liquid flow passage in the axial direction thereof, and having a diameter smaller than the external diameter of the nozzle main body; a second jet orifice which jets in an oblique upward direction, and is formed in the base section of the central jet tube; and an discharge controlling means formed below the second jet orifice, and on the outer circumferential section of the nozzle main body.

The discharge controlling means may be formed by a plurality of third jet orifices provided on the circumferential wall section of the nozzle main body so as to jet in an oblique upward direction. Furthermore, in another method, the discharge controlling means may be formed by a circular disk-shaped body which projects in the form of a flange from the circumferential wall section of the nozzle main body and which is larger than the diameter of an opening of the bottle to be washed. In the latter case, desirably, the outer edge section of the circular disk-shaped body is curved upward, and more desirably, one or more discharge holes are provided in the circular disk-shaped body.

According to the present invention, by providing the discharge controlling means below the second jet orifices, the amount of outflow of the washing liquid jetted into the bottle is restricted, and hence it is possible to form a reservoir of washing liquid to a height surpassing the position of the second jet orifices, even in the case of a bottle having an opening of large diameter. Thereby, a dispersion effect of the washing liquid is created by the jetting action from the second jet orifices, and hence uniform washing is performed, even in the case of a bottle having an opening of large diameter. Consequently, there is no need to exchange parts, even if there is variation in the diameter of the bottle opening, and hence uniform washing can be achieved, regardless of the size of the opening in the bottle. In the filling plant, there is no need to exchange parts, even in cases where bottles having openings of different diameters are filled on the same line.

BRIEF DESCRIPTION OF THE DRAWINGS

FIG. 1-A is a front side cross-sectional diagram of a bottle washing nozzle (Example 1) relating to an embodiment of the present invention;

FIG. 1-B is a plan view of same;

FIG. 3-A is a front side cross-sectional diagram of a bottle washing nozzle (Example 2) relating to a further embodiment of the present invention;

FIG. 3-B is a plan view of same; and

DESCRIPTION OF THE PREFERRED EMBODIMENTS

Figure 2:
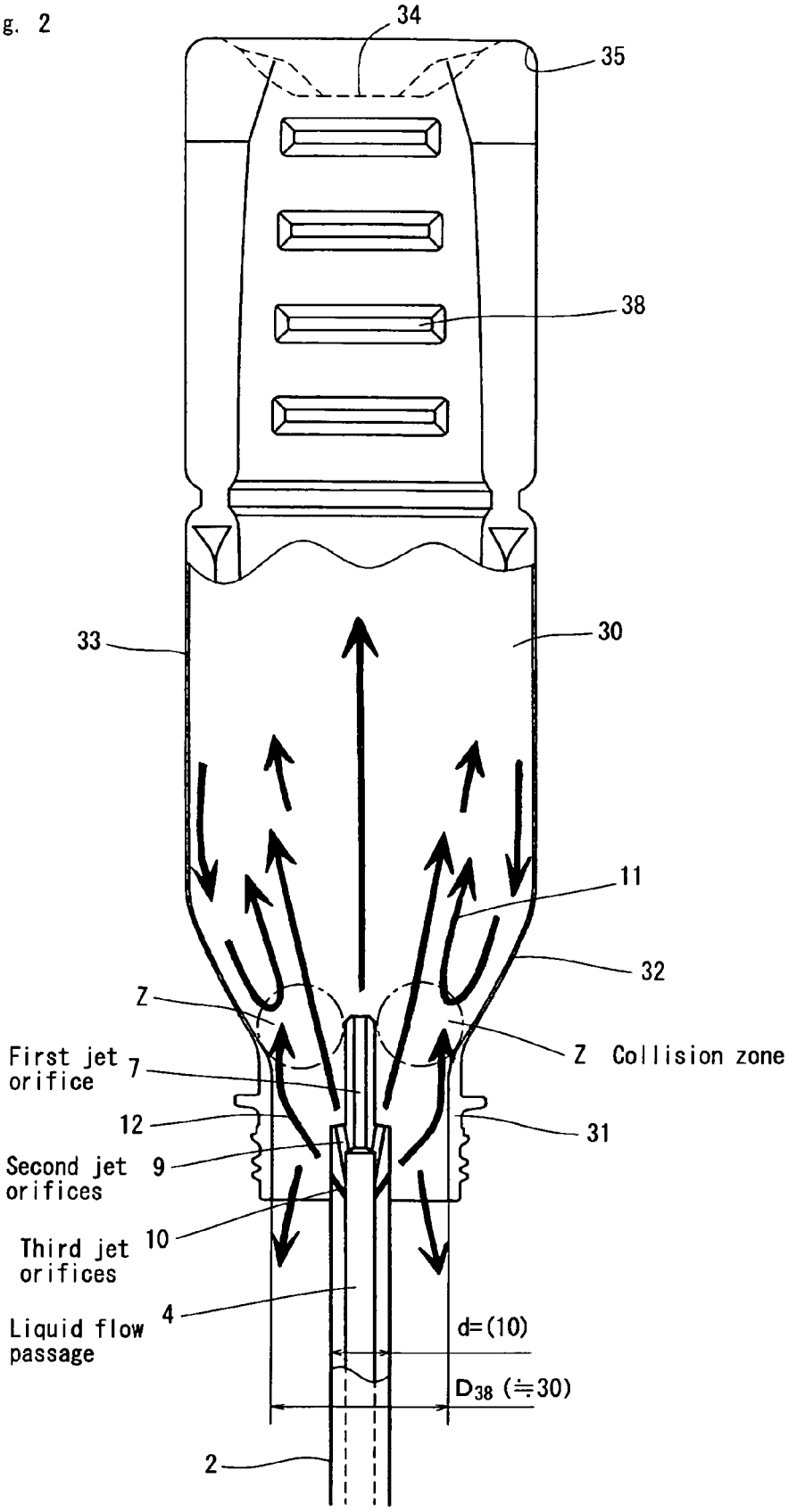
FIG. 2 is a schematic drawing showing a situation in which a bottle is being washed by the bottle washing nozzle according to Example 1.

FIG. 1-A is a front side cross-sectional diagram of a bottle washing nozzle relating to an embodiment of the present invention, and FIG. 1-A shows a plan view of same.

A bottle washing nozzle 1 comprises a base end side nozzle main body 2 on the base end side, and a central jet tube 5 which forms the front end section of the nozzle formed integrally with the nozzle main body 2, on the front end side of the nozzle main body 2. The nozzle main body 2 is a tubular body connected to a washing liquid supply tube which supplies washing liquid, such as hot water, sterilization liquid, or the like, and the inner part thereof forms a liquid flow passage 4 for the washing liquid. The washing referred to in the present invention includes washing the inside of a battle by means of normal washing liquid, as well as sterilization of the interior of the bottle by sterilization liquid and subsequent washing for rinsing purposes, and the washing liquid is not limited to being aseptic water, and it may be a sterilization liquid, hot water, pure water, or the like, and there are no particular restrictions on the type used. Typical examples of sterilization liquids for bottle sterilization are liquid sterilizing agents, such as a peracetic acid-based sterilizer, hydrogen peroxide, a hypochlorous acid-based sterilizer, and the like, but there are no particular limitations on the liquid sterilizing agent used, provided that it can be used to sterilize a container. The central jet tube 5 is connected to the liquid flow passage 4 of the nozzle main body 2 and it extends along the line of extension of the axis of the nozzle main body 2. The interior of the central jet tube 5 forms a first jet orifice 7 which jets washing liquid in a vertical direction. In a base section 8 where the central jet tube 5 connects to the nozzle main body 2, second jet orifices 9 are formed, separated respectively at intervals in a circumferential direction about the first jet orifice 7, each of the second jet orifices 9 being connected to the liquid flow passage 4 in the nozzle main body 2 and jetting washing liquid in an oblique upward direction. Therefore, the first jet orifice 7 opens at a position further toward the upper end than the second jet orifices 9. The first jet orifice 7 extends vertically in line with the axis of the nozzle main body 2 and therefore jets washing liquid straight up, but the second jet nozzles 9 are inclined at a prescribed angle (for example, 10 degrees) with respect to the axis of the nozzle main body 2, and hence they jet washing liquid in an oblique radial direction. In this example, the second jet orifices 9 have a smaller diameter than the first jet orifice 7, as shown in FIG. 1-B, and four of these second jet orifices 9 are formed at equidistant intervals in the circumferential direction. However, the number of these holes is not limited to this.

In the present embodiment, a plurality of third jet orifices 10 are provided as discharge controlling means, these orifices 10 being disposed below the second jet orifices 9 and connecting between the liquid flow passage 4 and the outer circumferential surface of the nozzle main body 2, in such a manner that they jet washing liquid in an oblique upward direction. The third jet orifices 10 are provided in order to generate a dispersion effect, as well as restricting the outflow of liquid by forcibly creating a collision area in and around the shoulder of the bottle in which the washing liquid jetted into the bottle is blown upwards, from below.

Desirably, the angle of inclination of the third jet orifices 10 with respect to the axis of the nozzle main body 2 is in the range of 25°-45°.

The bottle washing nozzle according to the present embodiment is composed as described above, and such nozzles are fixed in an upward orientation at a prescribed pitch in a bottle washing line, bottles supplied to a turret are held by a bottle holder in a standing state as shown in FIG. 2, and each nozzle is centered in position with respect to an opening 31 of a bottle 30, whereupon the nozzle is introduced into the bottle until the front end of the nozzle has passed a certain distance beyond the base end of the bottle opening and has reached the region of the opening of shoulder of the bottle. Therefore, the first jet orifices 7 is in a state where it has been introduced up to a shoulder 32 of the bottle 30, while the second jet orifices 9 open onto inner surface positions of the opening 31 of the bottle 30, and the third jet orifices 10 open onto inner surface positions of the opening 31 of the bottle 30, at a level below the second jet orifices 9.

By supplying liquid to the liquid flow passage 4 of the nozzle main body 2 in this state, the washing liquid is jetted simultaneously into the bottle, from the first jet orifices 7, the second jet orifices 9 and the third jet orifices 10. The first jet orifice 7 jets washing liquid toward the inner surface of a bottom 34 of the bottle 30, and the second jet orifices 9 jet washing liquid toward the side walls of a body 33 and the inner corners at boundary sections 35 between the body 33 and the bottom 34. The third jet orifices 10 jet toward the inner surface in the vicinity of the base end region of the bottle opening. In this state, when the washing liquid jetted by the first jet orifice 7 and the second jet orifices 9 makes contact with the inner surfaces of the bottle and returns downward, then by creating a collision zone Z in the vicinity of the entrance to the shoulder where this returning liquid collides with and is swept up by washing liquid 12 jetted from the third jet orifices 10, as indicated by arrows 11 in FIG. 2, the amount of liquid flowing out from the bottle opening is restricted. In this case, since the liquid jetted from the third jet orifices 10 performs the action of pushing back the washing liquid that is seeking to flow down out of the bottle, then even if the diameter of the opening of the container varies, this has little effect on the process and it is still possible to form a reservoir of collected liquid inside the bottle opening. The amount of jetted liquid should be adjusted in advance in such a manner that the amount of the collected liquid surpasses the position of the second jet orifices 9 and does not surpass the position of the first jet orifice 7.

Accordingly, by jetting washing liquid from the second jet orifices 9 into the reservoir of collected liquid, the accumulated jetted washing liquid is churned and swept upward, thus creating a dispersion effect in the washing liquid. The washing liquid swept up in this fashion receives a strong churning effect, and is propelled toward the inner surfaces of the bottle 30 with a certain dispersion (spread), thus producing an effect similar to that of shaking the contents of the bottle 30. Therefore, the washing liquid is able to make contact with each and every part of the inner surface of the bottle 30, in particular, beads 38, corner sections, boundary sections, and other parts that the washing liquid has difficulty in reaching, and hence washing can be performed reliably. As described above, in the present embodiment, the third jet orifices are provided as discharge controlling means, and therefore the outflow of washing liquid jetted into the bottle is restricted, and the reservoir of liquid can be formed readily in the bottle opening, even if the amount of liquid jetted in not large. Therefore, even if there is variation in the size of the bottle openings, for example, a bottle having a 28 mm dia. opening and a bottle having a 38 mm dia. opening, it is still possible to wash these bottles effectively by using the same bottle washing nozzle, without switching nozzles, and hence the problem of having to switch nozzle types as in the prior art technology is resolved.

Figure 4:
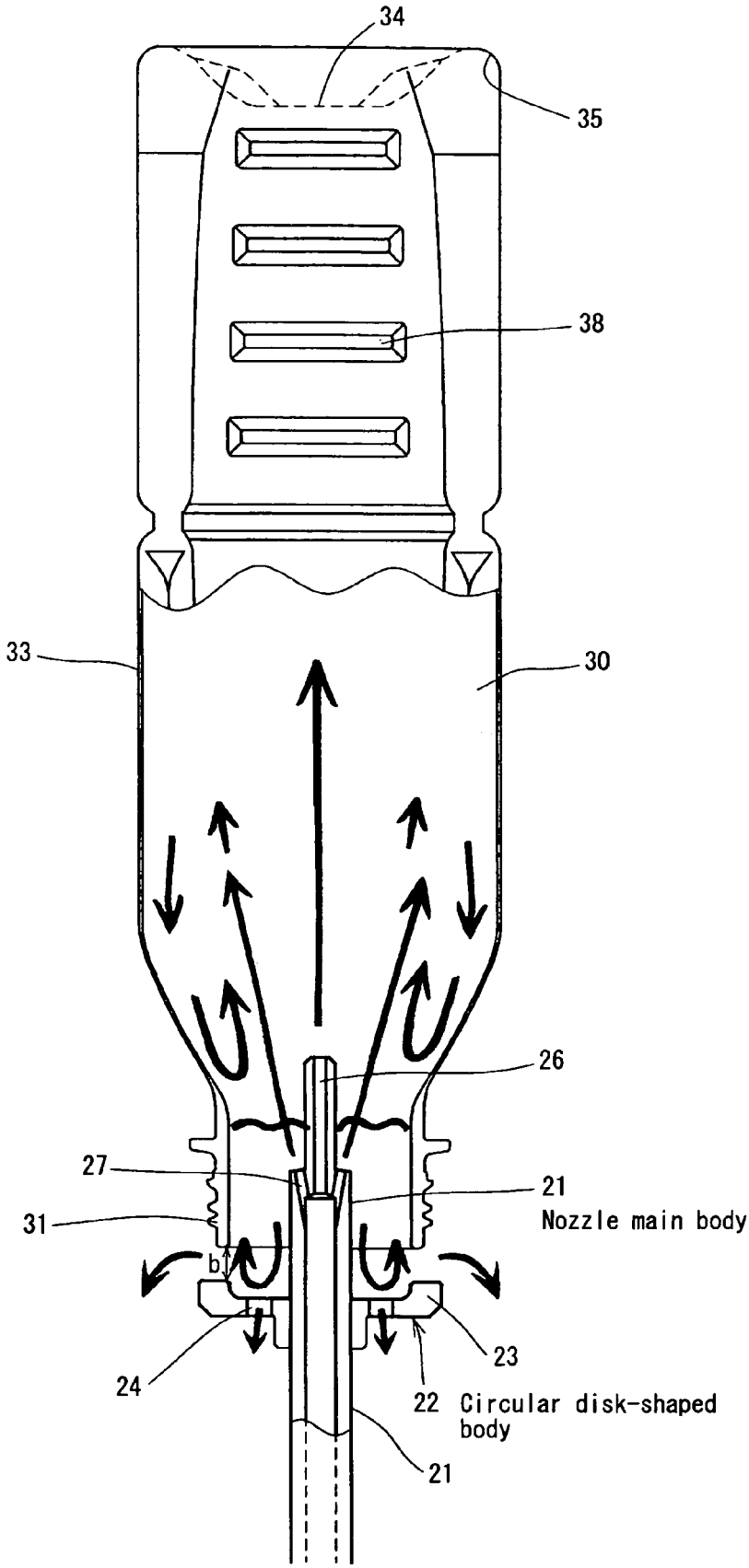
FIG. 4 is a schematic drawing showing a situation in which a bottle is being washed by the bottle washing nozzle according to Example 2.

FIG. 3 and FIG. 4 show a bottle washing nozzle relating to a further embodiment of the present invention. In comparison with the bottle washing nozzle 1 of the embodiment described above, a bottle washing nozzle 20 according to the present embodiment differs in that, instead of comprising third jet nozzles as an discharge controlling means, it comprises a circular disk-shaped body 22 which is larger than the bottle opening diameter to be washed and which projects in a flange shape from the outer circumference of a nozzle main body 21 in a position situated at a prescribed interval below the end of the bottle opening during washing. As shown in FIG. 4, the circular disk-shaped body 22 hinders the washing liquid flowing out of the bottle opening from flowing directly to the exterior of the bottle, and thus serves to restrict this outflow of liquid, and to create a dispersion effect by causing a prescribed amount of washing liquid to collect inside the bottle opening, even in the case of a wide-mouthed container in which there is a large interval between the bottle opening and the nozzle main body 21. The outer edge section of the circular disk-shaped body 22 is formed into an outer curved edge section 23 which projects upward, and furthermore, discharge holes 24 are provided to the inner side of this edge section. These discharge holes 24 are not an essential requirement, but if they are not provided, then the washing liquid only flows out in a sideways direction through the interval between the end of the bottle opening and the outer curved edge section 23 of the circular disk-shaped body 22, and hence the outflow characteristics are poor. Therefore, it is desirable to provide discharge holes in positions directly below the bottle opening. In the present embodiment, the discharge holes 24 are provided in four positions at 90° intervals located on the same circle, but there are no particular restrictions on their number, and one or more discharge holes may be provided. Furthermore, it is also possible to form the portion to the inner side of the outer curved edge section 23 by means of a multi-holed plate having a plurality of holes, and to form one or a plurality of discharge grooves in the outer curved edge section 23. When forming the discharge grooves in the outer curved edge section 23, the grooves may be combined with the discharge holes to the inner side thereof.

Similarly to the embodiment described above, a central jet tube 25, a first jet orifice 26, and second jet orifices 27, are provided in the upper part of the nozzle main body 21.

The bottle washing nozzle 20 according to the present embodiment has the composition described above and performs washing of a bottle in the state shown in FIG. 4. Similarly to the embodiment described above, the first jet orifice 26 jets washing liquid toward the inner surface of the bottom 34 of the bottle 30, and the second jet orifices 27 jet washing liquid toward the side walls of the body and the inner corners of the boundary section 35 between the body 33 and the bottom 34. The washing liquid jetted continuously into the bottle makes contact with the inner surfaces of the container and flows out to the exterior of the bottle via a ring-shaped interval created between the inner circumferential surface of the bottle and the nozzle main body 21, but since the circular disk-shaped body 22 is disposed below the bottle opening, then the washing liquid collects inside the opening due to this restriction of the outflow of liquid. The amount of washing liquid collected in the opening must ensure that the position of the liquid surface lies between the first jet orifice 26 and the second jet orifices 27, whereby a dispersion effect is generated by a churning action, due to the washing liquid that has flowed down inside the bottle 30 and is seeking to flow out from the opening 31 being swept upward by the washing liquid jetted from the second jet orifices 27. Therefore, the washing liquid is made to contact each and every part of the inner surface of the bottle 30, in particular, the beads 38, corner sections, boundary sections, and other sections that the washing liquid has difficulty in reaching, and hence washing can be performed reliably.

If the amount of washing liquid jetted into the bottle is uniform, then the amount of washing liquid collected in the opening 31 is dependent on the interval b between the end of the bottle opening and the upper end surface of the outer curved edge section 23 of the circular disk-shaped body 22. Consequently, if the washing nozzle is fixed in position, then it is possible to control the amount of washing liquid collected by adjusting the inserted position of the bottle, and therefore, even if the diameter of the bottle opening varies, it is possible to wash bottles of different opening diameters effectively by means of the same washing nozzle, by adjusting the inserted position of the bottle.

EXAMPLES

In order to confirm the effects of the present invention, using the bottle washing nozzle 1 according to the first embodiment (Example 1) and the bottle washing nozzle 20 according to the second embodiment (Example 2), bottles having an opening diameter of 28 mm and a capacity of 500 ml, and bottles having an opening diameter of 38 mm and a capacity of 500 ml, were washed respectively by the two bottle washing nozzles, in the following manner, without changing the nozzle between the different bottles.

In the case of each of the bottles, sterilization was performed by jetting a mixture of air and a chemical containing a 40,000 ppm concentration of hydrogen peroxide, into the bottle for 11 seconds, whereupon a washing liquid (aseptic water) was jetted into the bottle for 2.5 seconds by using the bottle washing nozzles of the first embodiment and the second embodiment, whereupon the washing concentration was compared by measuring the residual concentration of the chemical. Five bottles were washed respectively at settings of 100 ml/sec and 110 ml/sec for the amount of washing liquid jetted from the bottle washing nozzle. The corresponding results are shown in Table 1.

TABLE 1

| | | Residual concentration of chemical ppm | | | |
|---|---|---|---|---|---|
| | | Dia. 28 mm 500 square bottle | | Dia. 38 mm 500 square bottle | |
| Flow rate ml/sec | | Example 1 | Example 2 | Example 1 | Example 2 |
| 100 | 1 | 0.103 | 0.107 | 0.137 | 0.135 |
| | 2 | 0.106 | 0.103 | 0.130 | 0.137 |
| | 3 | 0.096 | 0.104 | 0.146 | 0.136 |
| | 4 | 0.101 | 0.104 | 0.123 | 0.123 |
| | 5 | 0.101 | 0.105 | 0.126 | 0.130 |
| | Average | 0.101 | 0.105 | 0.132 | 0.132 |
| 110 | 1 | 0.101 | 0.105 | 0.137 | 0.139 |
| | 2 | 0.103 | 0.114 | 0.140 | 0.128 |
| | 3 | 0.106 | 0.107 | 0.127 | 0.108 |
| | 4 | 0.102 | 0.109 | 0.122 | 0.128 |
| | 5 | 0.107 | 0.107 | 0.128 | 0.137 |
| | Average | 0.104 | 0.109 | 0.131 | 0.128 |

As shown in Table 1, the residual concentration of the chemical on the inner surfaces of the square bottles in Example 1 was an average of 0.101 ppm for square bottles having an opening of 28 mm diameter, and 0.132 ppm for square bottles having an opening of 38 mm diameter. The residual concentration of the chemical on the inner surfaces of the square bottles in Example 2 was an average of 0.105 ppm for square bottles having an opening of 28 mm diameter, and 0.132 ppm for square bottles having an opening of 38 mm diameter. Therefore, although the average value for the square bottles having an opening of 38 mm diameter is approximately 0.020-0.030 ppm greater than that of the square bottles having an opening of 28 mm, in both cases, the overall residual concentration is clearly lower than the approval reference value of 0.5 ppm for the residual concentration of chemical according to the prior art. Hence, it was confirmed that the bottles could be washed satisfactorily without any practical problems, in the case of both Example 1 and Example 2, and therefore, that both bottles having an opening of 38 mm diameter and bottles having an opening of 28 mm diameter can be washed effectively by means of the same washing nozzle, without having to change the nozzle. In Example 2, a bottle washing nozzle having the same dimensions of 10 mm outer diameter of the nozzle main body, and four outflow holes of 4 mm diameter, was used, and at a uniform nozzle flow rate, the distance of the interval in the axial direction between the end of the bottle opening and the outer curved edge of the circular disk-shaped body was set to 2 mm in the case of the bottle having an opening of 28 mm diameter, and the distance of the interval in the axial direction between the end of the bottle opening and the outer curved edge of the circular disk-shaped body was set to 5 mm in the case of the bottle having an opening of 38 mm diameter.

What is claimed is:

1. A bottle washing nozzle which jets a washing liquid inside a bottle, comprising:

a first jet orifice which jets in a vertical direction and is formed in a central jet tube, provided in an upper end portion of a nozzle main body comprising a liquid flow passage in the axial direction thereof, and having a diameter smaller than the external diameter of the nozzle main body;

a second jet orifice which jets in an oblique upward direction, and is formed in a base section where the central jet tube connects to the nozzle main body; and a discharge controlling means formed below the second jet orifice, and on an outer circumferential section of the nozzle main body wherein the discharge controlling means restricts an amount of liquid flowing out from a bottle opening and forms a reservoir of collected liquid inside the bottle opening.

2. The bottle washing nozzle according to claim 1, wherein the discharge controlling means comprises a plurality of third jet orifices provided on a circumferential wall section of the nozzle main body so as to jet in an oblique upward direction.

3. The bottle washing nozzle according to claim 1, wherein the discharge controlling means comprises a circular disk-shaped body, which projects in the form of a flange from the circumferential section of the nozzle main body, and which is larger than the diameter of an opening of the bottle to be washed.

4. The bottle washing nozzle according to claim 3, wherein one or more discharge holes are provided in the circular disk-shaped body.

* * * * *